US006321454B1

(12) United States Patent
Wass

(10) Patent No.: US 6,321,454 B1
(45) Date of Patent: Nov. 27, 2001

(54) UTILITY KNIFE

(76) Inventor: Steve Wass, P.O. Box 43522, Lower James PO, Hamilton (CA), L8P 4X5

( * ) Notice: Subject to any disclaimer, the term of this patent is extended or adjusted under 35 U.S.C. 154(b) by 0 days.

(21) Appl. No.: 09/335,708

(22) Filed: Jun. 18, 1999

(51) Int. Cl.[7] ..... B26B 29/02

(52) U.S. Cl. ..... 30/294; 30/123; 30/287; 30/289

(58) Field of Search ..... 30/2, 123, 286, 30/287, 289, 293, 294, 339, 296.1

(56) References Cited

U.S. PATENT DOCUMENTS

| | | | | |
|---|---|---|---|---|
| 1,795,527 | * | 3/1931 | Tyreman | 30/294 |
| 2,120,960 | * | 6/1938 | Arthur | 30/2 |
| 2,274,799 | * | 3/1942 | Kroemer | 30/2 |
| 2,978,807 | * | 4/1961 | Lurie | 30/2 |
| 4,041,605 | | 8/1977 | Selfridge | 30/293 |
| 4,043,038 | * | 8/1977 | Selfridge | 30/293 |
| 4,077,124 | | 3/1978 | Christmann | 30/287 |
| 4,130,939 | * | 12/1978 | Toal | 30/294 |
| 4,262,418 | * | 4/1981 | Hill et al. | 30/294 |
| 4,408,396 | | 10/1983 | Scholl | 30/294 |
| 4,602,433 | | 7/1986 | Whiting | 30/294 |
| 4,630,369 | | 12/1986 | Bourland | 30/294 |
| 4,884,342 | | 12/1989 | McNamara et al. | 30/162 |
| 5,561,906 | * | 10/1996 | Desmarais | 30/339 |
| 5,778,536 | * | 7/1998 | West | 30/123 |

* cited by examiner

*Primary Examiner*—Hwei-Siu Payer

(57) ABSTRACT

The present invention is a hand held utility knife for cutting and trimming materials such as carpet, vinyl, wallpaper and the like. The utility knife comprises a knife body adapted for grasping in a single hand and at least one knife blade mounted proximate a guide end in the knife body and having a cutting direction axis. The guide end includes at least one guide cheek defining a planar surface disposed at an angle theta relative to the knife blade such that the guide cheek is adapted to slidably engage and move parallel along an adjacent planar surface thereby ensuring that the blade cuts material at a uniform and preselected angle. The guide cheek ensures the knife cuts in a uniform angular relationship relative to an adjacent planar surface such that the guide minimizes rotation of the knife body about the cutting direction axis.

15 Claims, 7 Drawing Sheets

FIGURE - 2
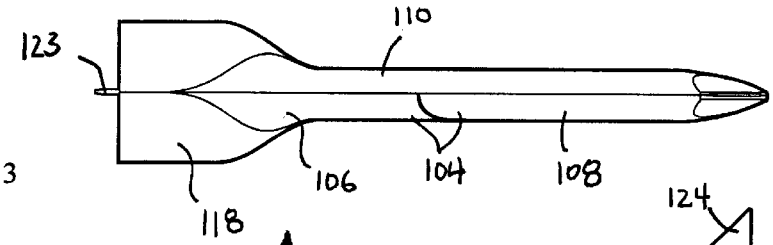
FIGURE - 3
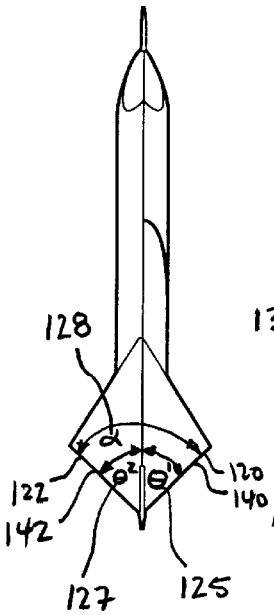
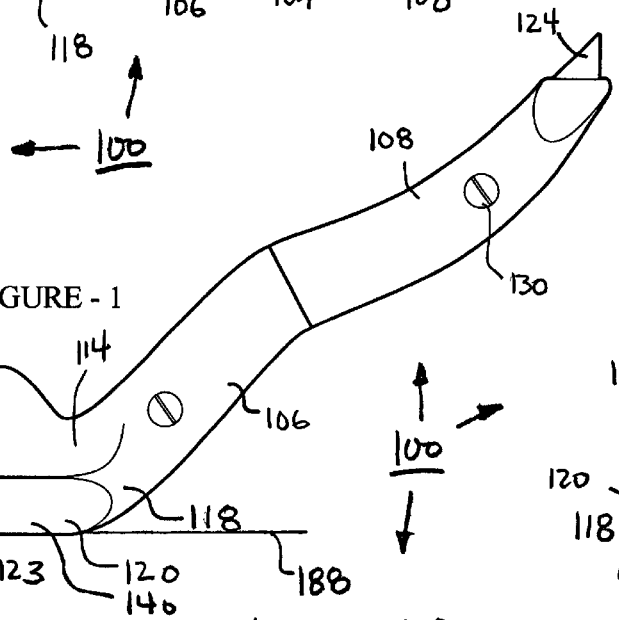
FIGURE - 1
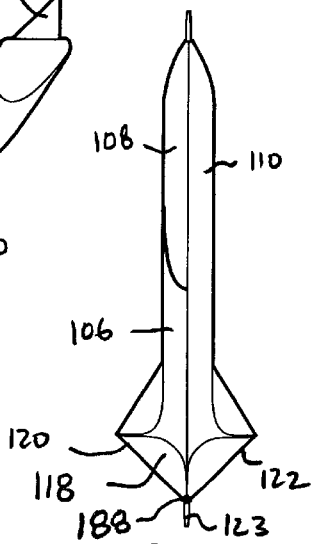
FIGURE - 4
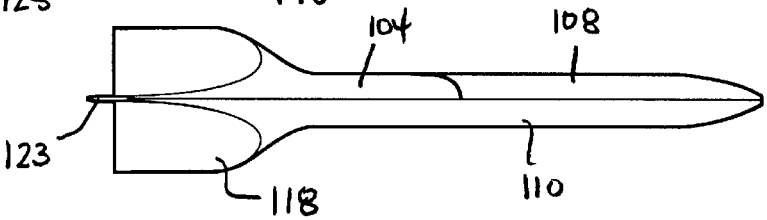
FIGURE - 5

FIGURE - 11
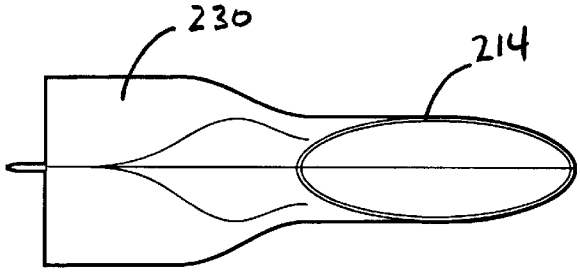
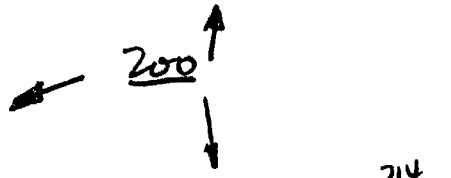
FIGURE - 12
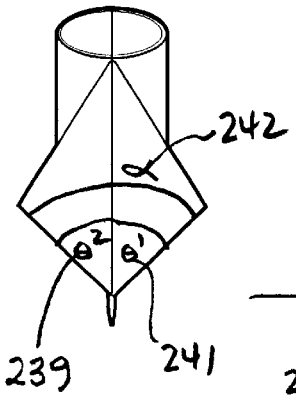
FIGURE - 10
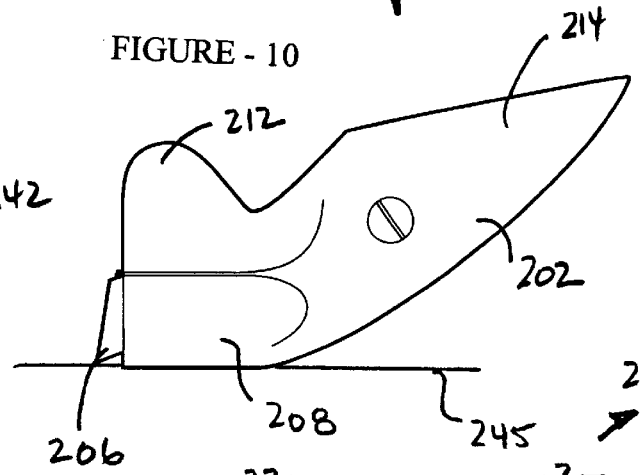
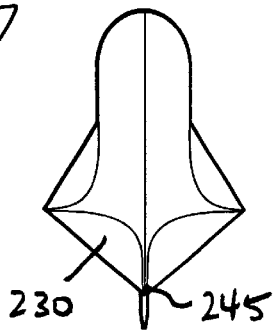
FIGURE - 13
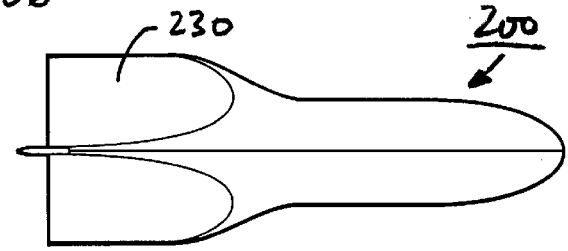
FIGURE - 14

UTILITY KNIFE

FIELD OF THE INVENTION

This invention relates generally to utility knives and more particular to a multi purpose utility knife which is particularly suited for trimming in corners and edges.

BACKGROUND OF THE INVENTION

Utility knives for cutting articles such as carpet, wall paper, drywall and other articles are well known in the art. For example, U.S. Pat. No. 5,561,906 titled Carpet Knife to Armand Desmarais issued Oct. 8, 1996 describes a knife specifically designed for trimming of carpets and also for creasing of carpets in the corners. U.S. Pat. No. 4,744,146 to Gregory Schmidt for an Adjustable Blade Safety Knife with Carton-Cutting Guide issued May 17, 1988 describes utility knife having a safety guard and also a feature for guiding the knife when utilizing the knife for cutting carton.

There are also a number of other knives which are currently being sold on the market place which have various functions and are designed for cutting in specific applications or are designed for broad use for a number of applications.

Tradesman which are installing carpeting and/or vinyl flooring and/or wall paper at one stage of the installation process must trim off the excess carpet, vinyl or wall paper so that the edge end will evenly butt up against a wall or ceiling or trim pieces as the case may be. The installation of carpet, vinyl flooring and wall paper requires trimming off the excess materials in either corners or edges of a room where the carpet or vinyl abuts against a surface perpendicular or normal to the material being laid. Currently this trimming is normally done utilizing a standard utility knife similar to the one described in U.S. Pat. No. 5,561,906 wherein the person trimming must ensure that he is trimming the carpet and/or other material in such a manner to leave a flush even edge along the perpendicular or normal wall. During the trimming a standard utility knife must be angled property to ensure a square edge and to ensure that the cut is as uniform and as close to the wall as possible. Unfortunately even holding the knife at an improper angle will result in a longer and/or shorter cut. Therefore, during the trimming process constantly holding the knife at the proper trimming angle is an important aspect of the trimming process.

Therefore, it is desirable to have a knife which help controls the angle at which cutting takes place and aids in guiding the knife along at the proper angle as the trimming is carried out.

SUMMARY OF THE INVENTION

The present invention a hand held utility knife for cutting and trimming materials such as carpet, vinyl, wallpaper and the like, the utility knife comprises:

a) a knife body adapted for grasping in a single hand;

b) at least one knife blade mounted proximate a guide end in said knife body and having a cutting direction axis;

c) said guide end including a means for guiding said knife in a uniform angular relationship relative to an adjacent planar surface such that the guide means minimizes rotation of the knife body about said cutting direction axis.

Preferably the guide means comprises at least one guide cheek defining a planar surface disposed at an angle theta relative to said knife blade such that said guide cheek is adapted to slidably engage and move parallel along an adjacent planar surface thereby ensuring that the blade cuts material at a uniform and preselected angle.

Preferably the guide means comprises at least two guide cheeks defining a planar surface each disposed at an angle theta relative to said knife blade such that said guide cheeks are adapted to slidably engage and move parallel along adjacent planar surfaces, such as a floor and wall, thereby ensuring that the blade cuts material at a uniform and preselected angle.

Preferably the utility knife is specifically adapted for cutting and trimming in corners where two planar surfaces, such as where a floor and wall meet, wherein the guide means comprises a corner guide including first and second guide cheeks each defining a planar surface and disposed at an angle theta relative to said knife blade such that said first guide cheek is adapted to slidably engage and move parallel along a first planar surface, such as a floor, and said second guide cheek is adapted to slidably engage and move parallel along a second planar surface, such as a wall, thereby ensuring that the blade cuts material at a uniform and preselected angle.

Preferably the guide means comprises first guide cheek disposed at an angle theta one relative said knife blade and second guide cheek disposed at an angle theta two relative to said knife blade, and said angle theta one plus theta two equals angle alpha the angle between first guide cheek and second guide cheek.

Preferably wherein the angle alpha is approximately 90 degrees and angles theta one and theta two are each 45 degrees, which are the preferred angles for trimming of material in corners having two planar surfaces oriented substantially 90 degrees relative each other.

Preferably wherein the knife body comprises a utility end and said guide end, said the utility end including a second knife blade, such that the guide end is used for cutting and trimming in corners and the second knife blade mounted in said utility end is used for conventional utility knife cutting and trimming operations.

Preferably the knife body comprises a utility end and said guide end, wherein the utility end including a second chisel end, such that the guide end is used for cutting and trimming in corners and the second chisel end is used for creasing, smoothing and like operations when installing carpet, vinyl, wallpaper and the like.

Preferably the knife body comprises a chisel end proximate said guide end, such that the guide end is used for cutting and trimming in corners and the chisel end is used for creasing, smoothing and like operations when installing carpet, vinyl, wallpaper and the like, and said second knife blade mounted in said utility end is used for conventional utility knife cutting and trimming.

An alternate embodiment of the present invention a utility knife attachment for use with commercially available hand held utility knives, the utility knife attachment comprises:

a) a knife attachment body including a guide end;

b) a means for releasably connecting said knife attachment to commercially available utility knives;

c) at least one knife blade at said guide end mounted in said knife body and having a cutting direction axis;

d) said guide end including a means for guiding said knife in a uniform angular relationship relative to a planar surface such that the guide means minimizes rotation of the knife body about said cutting direction axis.

The utility knife attachment preferably wherein the guide means comprises at least one guide cheek defining a planar surface disposed at an angle theta relative to said knife blade such that said guide cheek is adapted to slidably engage and move parallel along an adjacent planar surface thereby ensuring that the blade cuts material at a uniform and preselected angle.

The utility knife attachment preferably wherein the guide means comprises at least two guide cheeks defining a planar surfaces disposed at angles theta relative to said knife blade such that said guide cheeks are adapted to slidably engage and move parallel along adjacent planar surface, such as a floor and wall, thereby ensuring that the blade cuts material at a uniform and preselected angle.

The utility knife attachment preferably specifically adapted for cutting and trimming in corners where two planar surfaces, such as where a floor and wall meet, wherein the guide means comprises a corner guide including first and second guide cheeks each defining a planar surface and disposed at an angle relative to said knife blade such that said first guide cheek is adapted to slidably engage and move parallel along a first planar surface, such as a floor, and said second guide cheek is adapted to slidably engage and move parallel along a second planar surface, such as a wall, thereby ensuring that the blade cuts material at a uniform and preselected angle.

The utility knife attachment preferably specifically adapted for cutting and trimming in corners where two planar surfaces, such as where a floor and wall meet, wherein the guide means comprises first guide cheek disposed at an angle theta one relative said knife blade and second guide cheeks disposed at an angle theta two relative to said knife blade, and said angle theta one plus theta two equals angle alpha the angle between first guide cheek and second guide cheek.

The utility knife attachment preferably specifically adapted for cutting and trimming in corners where two planar surfaces, such as where a floor and wall meet, wherein the angle alpha is approximately 90 degrees and angles theta one and theta two are each 45 degrees, which are the preferred angles for trimming of material in corners having two planar surfaces oriented 90 degrees relative each other.

The utility knife attachment preferably wherein the knife attachment body comprises a chisel end proximate said guide end, such that the guide end is used for cutting and trimming in corners and the chisel end is used for creasing, smoothing and like operations when installing carpet, vinyl, wallpaper and the like.

A further alternate embodiment in combination a knife attachment and a commercially available hand held utility knife, the combination comprising said knife attachment releasably attached and mated to said commercially available hand held knife with said connecting means such that the knife attachment mated together with said utility knife is adapted for cutting and trimming in corners where two planar surfaces, such as where a floor and wall meet.

Preferably said combination comprising:

a) said knife attachment releasably attached and mated to said commercially available hand held knife with said connecting means;

b) wherein said connecting means includes a boot connector for snugly receiving the cutting end of said commercially available utility knife; and c) said connecting means further comprising a locking screw for releasably clamping said knife attachment to said cutting end of said commercially available utility knife such that such that the knife attachment mated together with said utility knife is adapted for cutting and trimming in corners where two planar surfaces, such as where a floor and wall meet.

Preferably said combination comprising:

a) said knife attachment releasably attached and mated to said commercially available hand held knife with said connecting means;

b) wherein said connecting means includes a boot connector for snugly receiving the cutting end of said commercially available utility knife; and c) said connecting means further comprising a locking screw for releasably clamping said knife attachment to said cutting end of said commercially available utility knife such that the knife attachment mated together with said utility knife is adapted for cutting and trimming in corners where two planar surfaces, such as where a floor and wall meet.

BRIEF DESCRIPTION OF THE DRAWINGS

The invention will now be described by way of example only, with references to the following drawings in which:

FIG. 1 is a side elevational view of the present invention, a utility knife.

FIG. 2 is a top plan view of the present invention, a utility knife.

FIG. 3 is a front elevational view of the present invention, a utility knife.

FIG. 4 is a back elevational view of the present invention, a utility knife.

FIG. 5 is a bottom plan view of the present invention, a utility knife.

FIG. 10 is a side elevational view of an alternate embodiment of the present invention, a knife attachment FIG. 11 is a top plan view of the knife attachment.

FIG. 12 is a front elevational view of the knife attachment.

FIG. 13 is a back elevational view of the knife attachment.

FIG. 14 is a bottom plan view of the knife attachment.

DETAILED DESCRIPTION OF THE PREFERRED EMBODIMENT

Definitions

"thin planar materials"; as used in this patent refers to thin planar materials normally cut by utility knifes. These materials include, but are not limited to carpet, vinyl, vinyl flooring, wall paper and paper.

"Interior corner"; as used in this patent refers to corners having an interior angle of 180 degrees or less. Normally such interior corners define an interior angle of 90 degrees. Examples of the most common interior corners are: where two interior walls meet, where a wall and ceiling intersect, and where a wall and floor intersect.

Figures 6, 7:
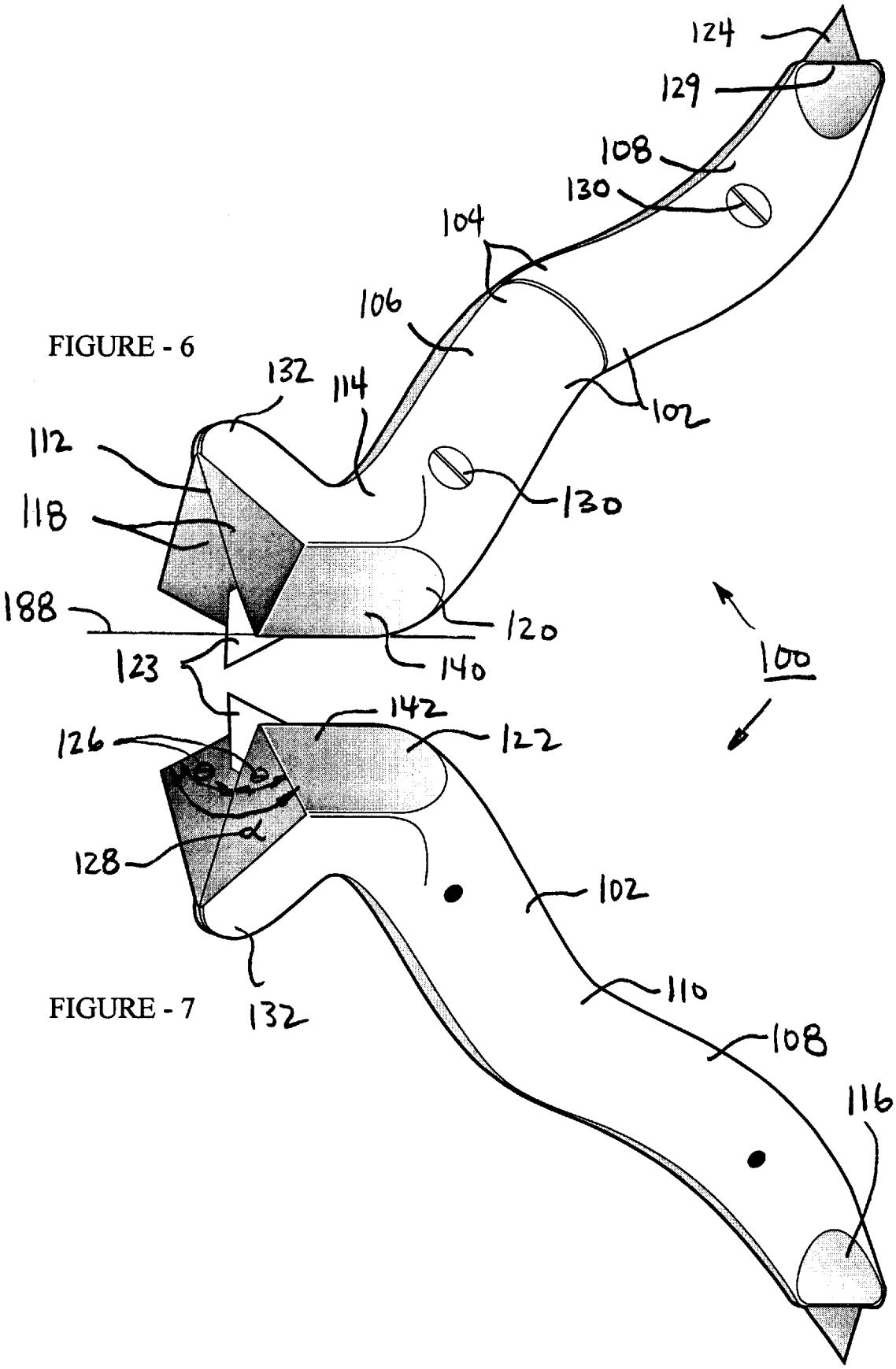
FIG. 6 is a schematic perspective view showing the first side of the present invention, a utility knife.
FIG. 7 is a schematic perspective view showing the second side of the present invention, a utility knife.

The present invention, a utility knife is shown generally as 100 in FIGS. 6 and 7. Utility knife 100 is comprised of a knife body 102 having a first side 104 and a second side 110, first side 104 also includes utility section 108 and guide section 106. First side 104 and second side 110 mate together along parting line 112. Knife body 102 has a guide end 114 and a utility end 116. Guide end 114 i s comprised of a corner guide 118 having a first guide cheek 120 and a second guide cheek 122. Guide end 114 also includes a first blade 123. Utility end 116 is shown with a second blade 124 in place, however, second blade 124 is optional and utility end 116 can be used with or without second blade 124.

First guide cheek 120 and second guide cheek 122 of corner guide 118 are substantially planner surfaces disposed at specific angles theta 126 relative to the knife blade 123. The angle theta one 125 being the angle between the first plane 140 of first guide cheek 120 relative to first blade 123. The angular relationship between the second plane 142 of second guide cheek 122 and first blade 123 is shown as angle theta two 127. The angular relationship between the first plane 140 relative to the second plane 142 particularly as shown in FIG. 3 being the front elevational view of the utility knife 100 is angle alpha 128. (Note: The angle theta 126 is measured from the planes defined by first or second guide cheeks 120 and 122 and the planar surface of blade 123)

Screws 130 securely attach utility section 108 to second side 110 as well as a guide section 106 to second side 110. Screws 130 are the type that can easily be opened and closed by using either a screw driver and/or a coin for quick access into the interior of knife body 102.

The shape of knife body 102 is not critical, however the shape as shown in FIGS. 1 through 9 is an ergonomic design which is comfortable to hold in the users hand. In addition, optionally knife body 102 has a chisel end 132 which can be used for creasing carpets and/or vinyl, however alternatively second chisel end 129 of utility end 116 without second blade 124 in place can also be used to crease carpet and or vinyl.

Utility end 116 therefore can be used as either a traditional utility type knife with second blade 124 in place or can be used as a chisel end or blunt instrument for creasing carpets and/or vinyl and/or wall paper. The radius and shape of chisel end 132 may be varied from either rounded and blunt to fairly sharp. The same also applies to the utility end 116 proximate where second blade 124 emerges from knife body 102, namely second chisel end 129 can be rounded or fairly sharp.

Figures 8, 9:
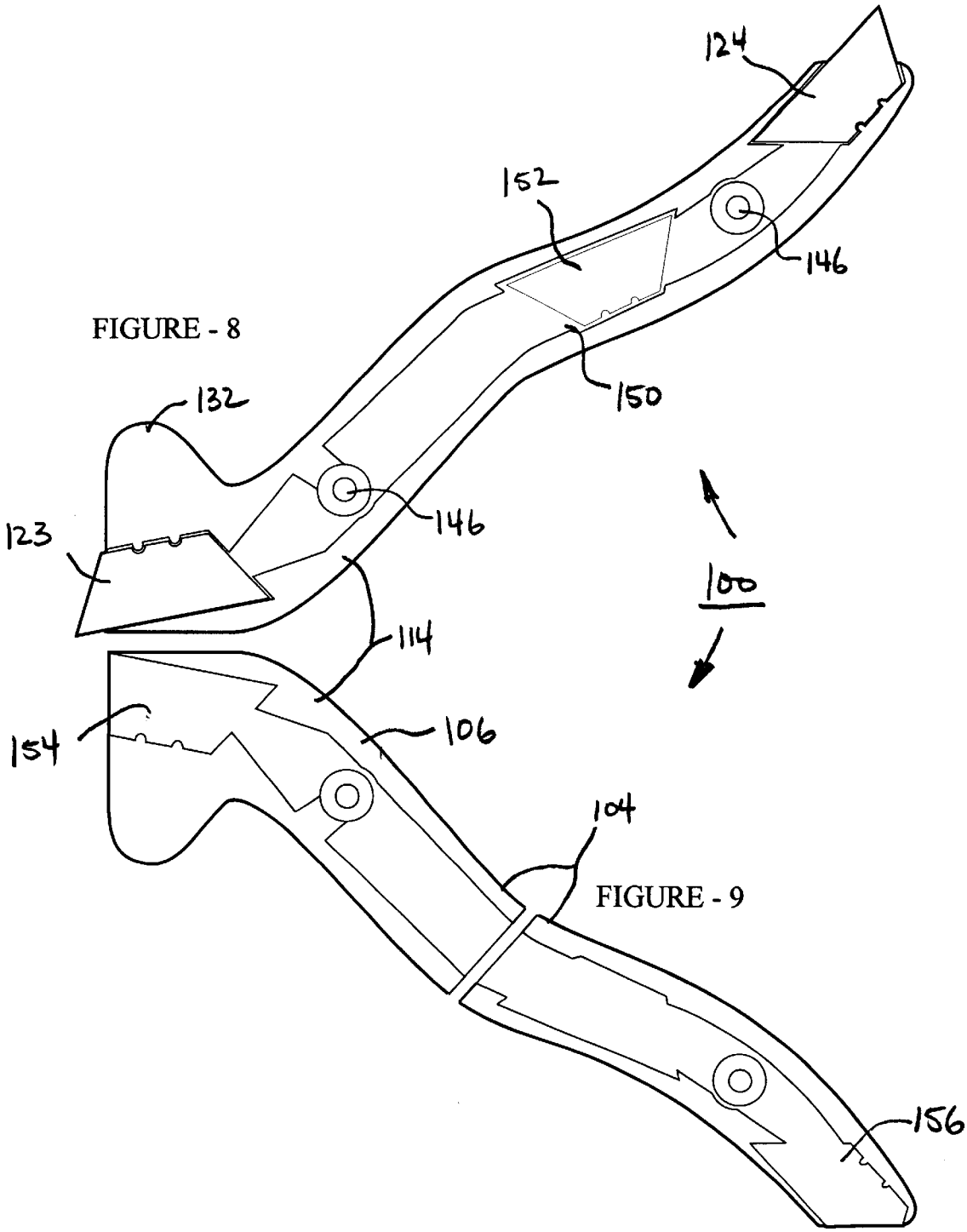
FIG. 8 is a schematic plan view with the first side removed showing the interior of the second side of the utility knife.
FIG. 9 is a schematic plan view of the interior of the utility knife with the second side removed showing the interior of the first side.
Figures 15, 16:
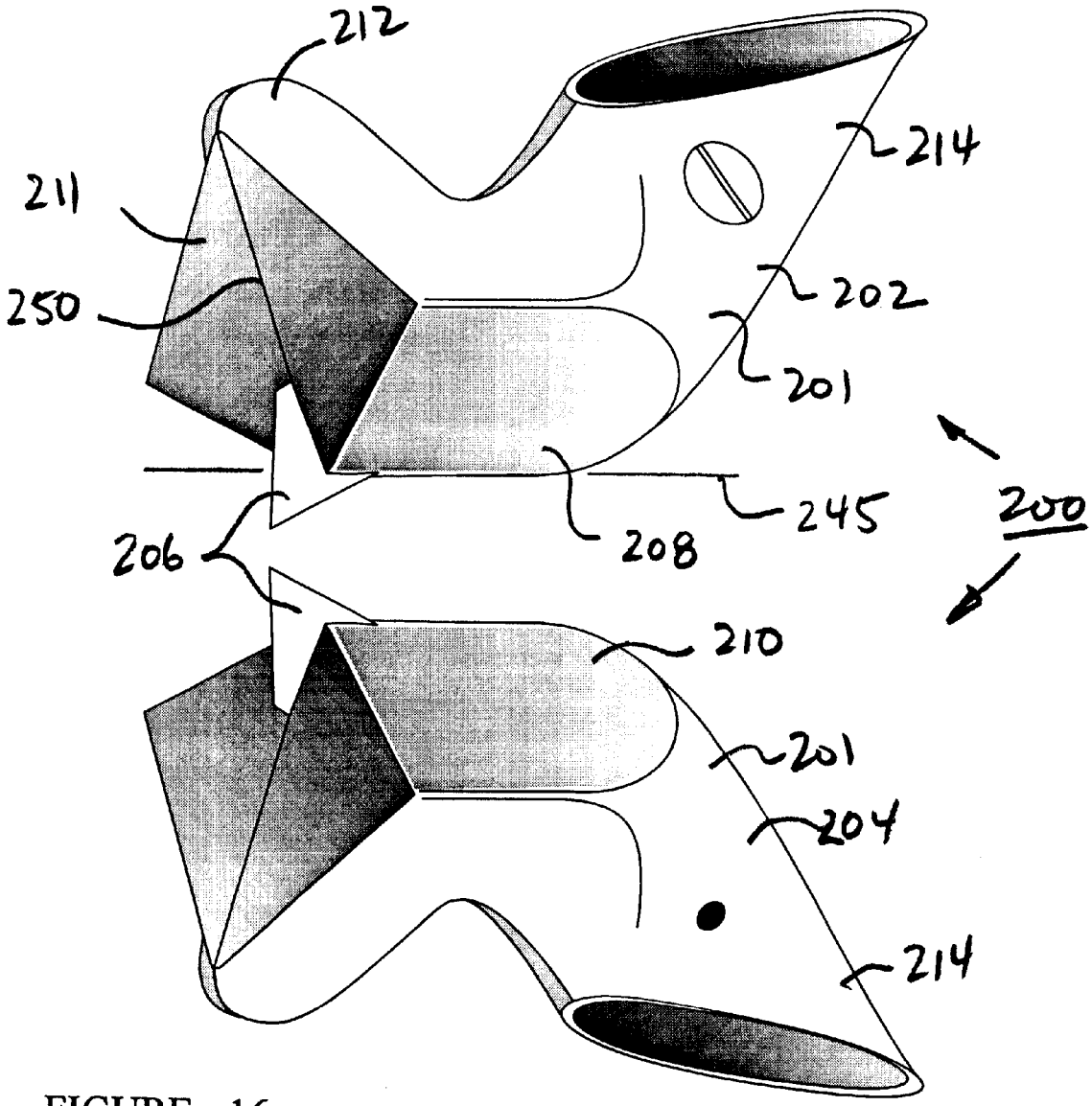
FIG. 15 is a schematic perspective view showing the first side of the knife attachment.
FIG. 16 is a schematic perspective view showing the second side of the knife attachment.

Referring now to FIGS. 8 and 9 which show the interior of knife body 102, FIG. 8 shows the interior of second side 110 having first blade 123 and second blade 124 in situ and said blades 123 and 124 being held in place by first blade holder 154 and second blade holder 156 which is integrally part of second side 110. In addition, second side 110 has defined therein a spare blade compartment 150 housing spare blades 152. Screws 130 threadably engage with threaded screw apertures 146 for mating utility section 108 and guide section 106 together with second side 110. FIG. 8 and FIG. 9 show utility knife 100 taken apart along parting line 112 and laid open to show the interior of second side 110, utility section 108 and guide section 106.

In use corner guide 118 of utility knife 100 serves to ensure the correct orientation of first blade 123 while cutting. For example, when trimming vinyl flooring along a floor wall interface which normally are oriented approximately 90 degrees relative each other, first guide cheek 120 for example would be sliding parallel and along the floor whereas second guide cheek 122 would be sliding parallel and along to the wall. In this example, utility knife 100 would have an angle alpha 128 of roughly 90 degrees since that is angle between most walls and floors and angle theta 126 would each be 45 degrees. In this manner the angle of first blade 123 would be held at an angle substantially bisecting the angle between the floor and the wall, namely the material would be cut at approximately a 45 degree angle relative to the floor or the wall. Therefore corner guide 118 minimizes rotation of the knife body 102 about cutting direction axis 188. As one moves the blade along the floor and the wall, the guide cheeks 120 and 122 maintain contact with the floor and walls in order to maintain a uniform angle of first blade 123 relative to the material that is being cut. Those skilled in the art of cutting vinyl flooring and/or carpeting and/or wall paper and/or any other materials requiring trimming near floor/wall interfaces know that the angle of the blade that is cutting the material is critical since a change in angle means a potential change in length of the material that is left to abut into the corner. Preferably the angle of the blade should bisect the angle between the normal surfaces since this angle leaves material behind which evenly abuts the normal surface (ie. Wall or ceiling).

Therefore, preferably the angle alpha 128 is approximately 90 degrees and both angles theta 126 are 45 degrees. In other situations however, different values of alpha 128 and theta 126 may be preferable depending on the amount of material that one wishes to leave abutting into a corner area and also the relative orientation between the wall and floor for example. It is also possible to maintain a constant value of the angle alpha 128 and change the ratio between theta one 125 of the first guide cheek 128 and the value of theta two 127 of the second guide cheek 122. In this manner rather than bisecting the angle between a wall and floor for example the material could be cut at a 60 degree angle relative to the floor and/or a 40 degree angle relative to the floor and/or any other angle which is found to be appropriate to the user.

In addition to being especially useful for trimming carpet and vinyl flooring, utility knife 100 can also be used for trimming wall paper which abuts into a corner and/or any other materials requiring trimming which need to be trimmed off at an interface between a surface being covered and where the covering material ends by abutting a normally disposed surface such as a wall or ceiling or trim piece.

In addition utility knife 100 has a chisel end 132 on guide end 114 which can be used to crease carpet or vinyl and/or wall paper to force the covering material into the corner where the trimming is to take place. In addition Utility knife 100 has at utility end 116 with a second blade 124 which optionally can be used depending on the situation. If a great deal of utility cutting is required, then the user may choose to place second blade 124 in situ and use utility end 116 as a normal hand held type of utility knife.

On the other hand by removing second blade 124, second chisel end 129 can be used for a variety of purposes including creasing of carpet and vinyl and/or can be shaped for smoothing and/or other functions required of carpet layers, vinyl floor layers and/or wall paper hangers.

In order to change the blade, either guide section 106 can be removed independently of utility section 108 or both compartments can be removed simultaneously. By threadably removing screws 130 first sides 104 can be removed from second side 110 exposing spare blade compartment 150 and spare blades 152 housed therein. First blade 123 can be removed from first blade holder 154 and replaced as well as second blade 124 can be removed from second blade holder 156 and replaced.

Figure 17:
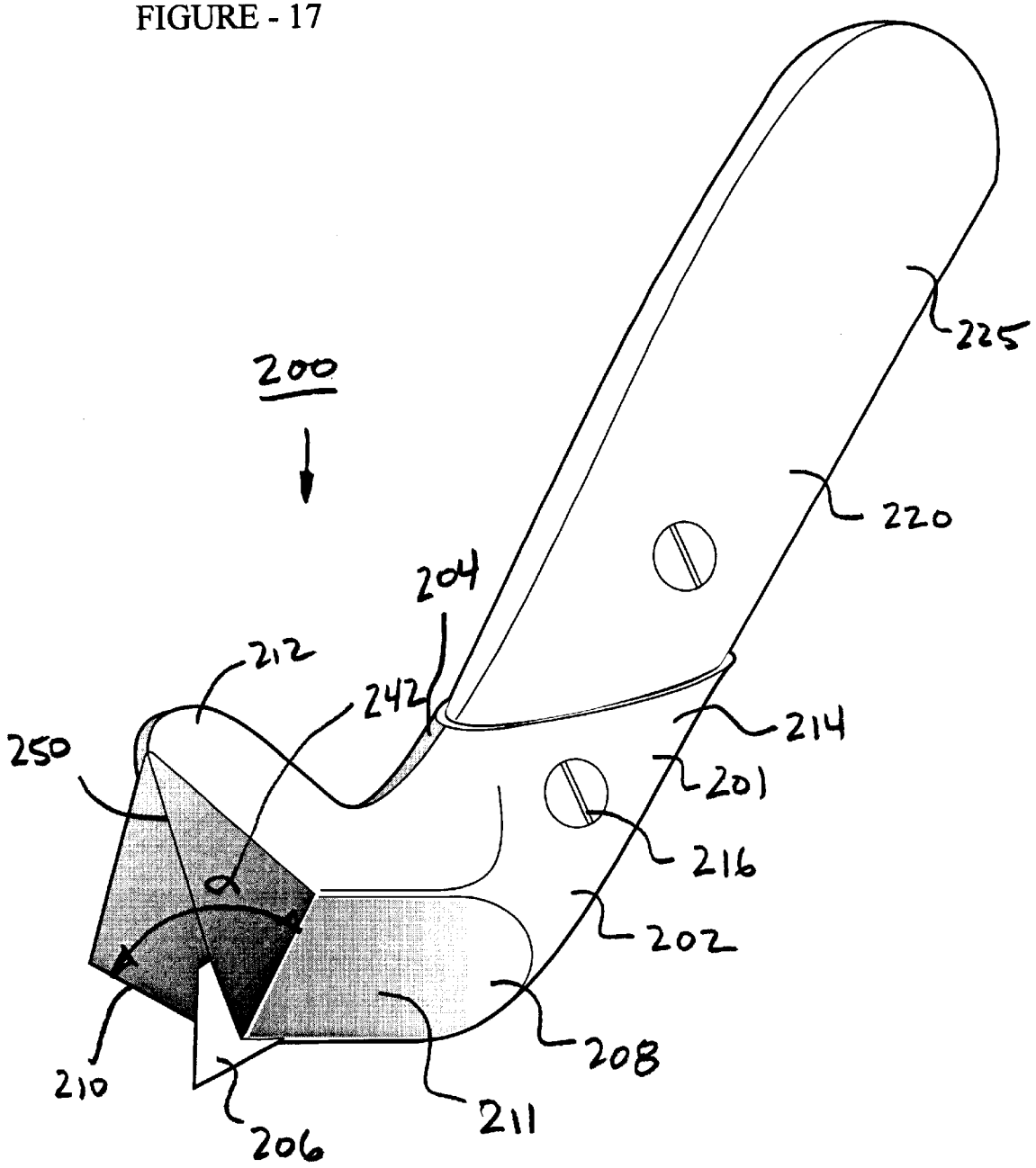
FIG. 17 is a perspective schematic view of the knife attachment being deployed together with a utility knife which is generally commercially available.
Figure 18:
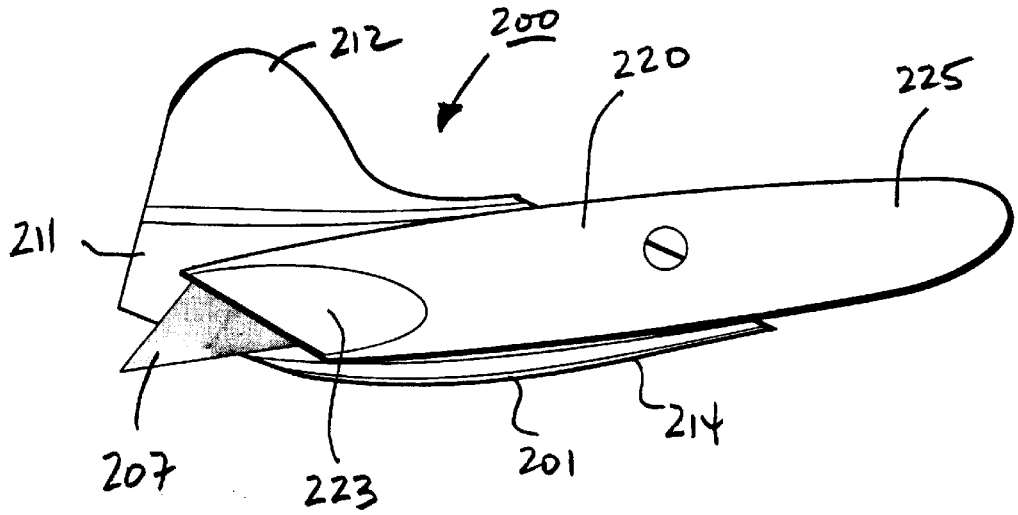
FIG. 18 is a schematic cutaway view showing a commercially available utility knife deployed inside the knife attachment.
Figure 19:
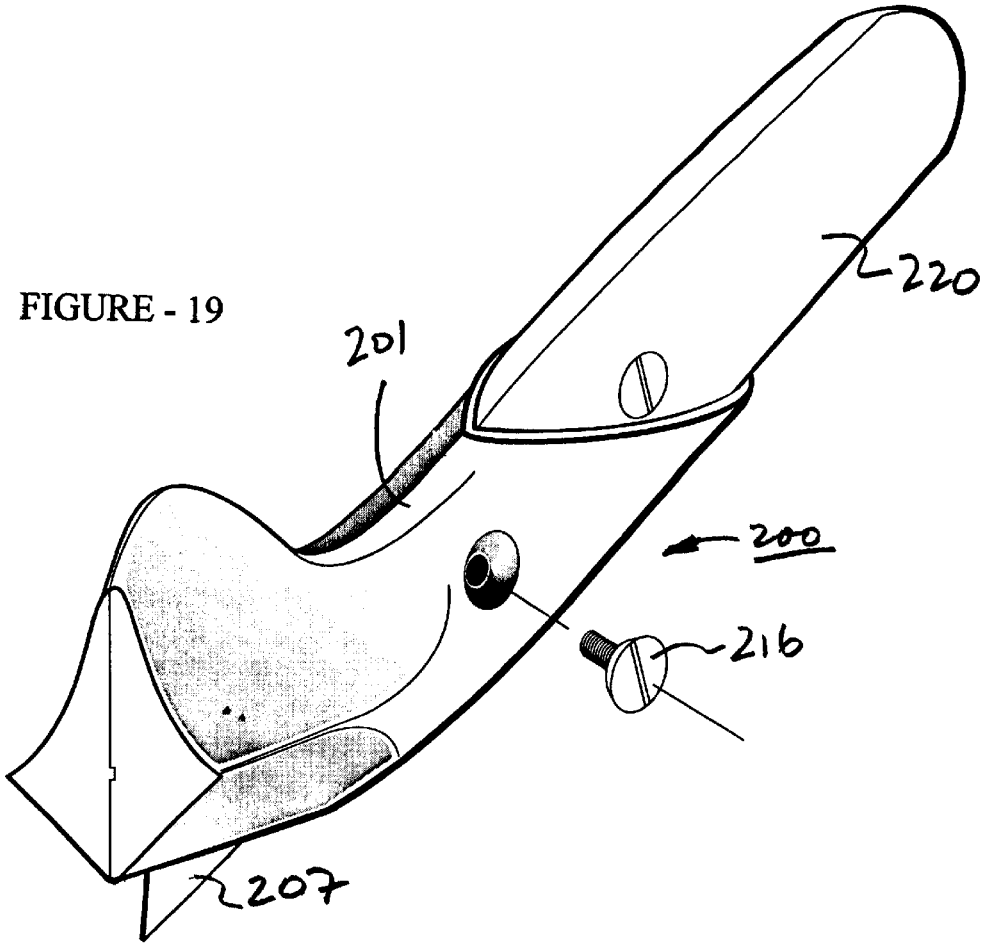
FIG. 19 is a perspective schematic view of the knife attachment being deployed together with a utility knife which is generally commercially available.

An alternate embodiment of the present invention is shown in FIGS. 10 through 19 a knife attachment shown generally as 200. Referring to FIG. 17 and 18 a utility knife 220 has a handle end 225, a cutting end 223, and a blade 207. Referring to FIG. 17 and 18 utility knife 220 which is of the type which is readily commercially available and may be manufactured out of metal or plastic and may be of the type having single blades and/or retractible blades and/or blades which can be sharpened by breaking off a portion of the blade (also known as disposable utility knives).

The alternate embodiment shown as knife attachment 200 comprises a knife attachment body 201, having a guide end 211, chisel end 212, and a boot connector 214 having a first side 202 and a second side 204 and is connected to utility knife 220 using locking screw 216. Knife attachment 200 also has a corner guide 230 (analogous to the previous embodiment, utility knife 100 which has a corner guide 118) with a first guide cheek 208 and a second guide cheek 210 having a blade 206 disposed there between. Knife attachment 200 has cutting direction axis 245 defined along the cutting direction of the blade. Boot connector 214 is dimensioned to snugly fit onto the end of utility knife 220 not shown in FIGS. 15 and 16.

The angle theta one 241 being the angle between the first guide check 208 relative to the first blade 206. The angular relationship between the second guide check 210 and first blade 206 is shown as angle theta two 239.

Locking screw 216 is designed to clamp down onto the body of utility knife 220, therefore holding knife attachment 200 together with utility knife 220. Knife attachment 200 may utilize the blade 207 as shown in FIG. 18 which is integrally part of utility knife 220 and/or it may have its own blade 206 which comes with knife attachment 200 as shown in FIG. 17. Knife attachment 200 may or may not have parting line 250 and may or may not be capable of being split in half along parting line 250, but rather may be one integral unit manufactured out of metal and/or plastic for snugly fitting boot connector 214 onto utility knife 220. In analogous fashion to the previous embodiment, (utility knife 100, having angle alpha 128 and theta 126) knife attachment 200 has analogous angles theta 240 theta one 241 and theta two 239 and alpha 242.

FIG. 18 shows schematically how a commercially available utility knife 220 mates into boot connector 214 of knife attachment 200. Utility knife 220 mated together with knife attachment 200 functions in a similar manner as the previous embodiment utility knife 100. Other ways known in the art of connecting and locking together knife attachment 200 with utility knife 225 can be utilized without departing from the spirit of this invention. It may not be necessary to use locking screw 216 but rather a pin arrangement, dovetail arrangement, friction fit or any other means known in the art may be used.

In use knife attachment 200 is attached to a utility knife 220 which is of the type commercially available in the industry. FIG. 17 and 18 depict schematically how one such knife may look, however, knife attachment 200 can be configured to mate snugly with many other types of the utility knifes that are available on the market. In particular it can be adapted to work with the disposable blade type utility knives, the retractable blade type utility knives and/or the type of utility knives that are sharpened by breaking away a portion of the knife blade itself. Alternatively knife attachment 200 may have its own blade 206 which can be made to be replaceable. Knife attachment 200 may or may not have a first side 202 and second side 204 which can be split apart for replacement of blades 206 therein. Knife attachment 200 preferably is made of one integral unit wherein the blade 207 utilized comes with the utility knife 220. Comer guide 230 works in analogous fashion as corner guide 118 does as described above in the previous embodiment a utility knife 100.

First guide cheek 120 is analogous to first guide cheek 208, and second guide cheek 122 is analogous to second guide cheek 210. Knife attachment 200 mated together with a utility knife 220 functions in analogous fashion as described above for utility knife 100.

A person skilled in the art will realize that knife attachment 200 is an attachment to retrofit existing utility knives in order to provide existing utility knifes with a guide for producing a more uniform cut of materials which require trimming along corners and/or specific edges.

It will be apparent to persons skilled in the art, various modifications and adaptations of the structure described above are possible without departure from the spirit of the invention, the scope of which is defined in the appended claims.

I claim:

1. A hand held utility knife for cutting and trimming thin planar materials, the utility knife comprising:

a) a knife body adapted for grasping in a single hand;

b) at least one knife blade mounted proximate a guide end in said knife body and having a cutting direction axis;

c) said guide end including a guide means for guiding said knife along an interior corner in a uniform angular relationship relative to an adjacent planar surface such that the guide means minimizes rotation of the knife body about said cutting direction axis, (d) wherein the guide means comprises at least one guide cheek defining a planar surface disposed at an angle theta relative to said knife blade such that said guide cheek is adapted to slidably engage and move parallel along an adjacent planar surface thereby ensuring that the blade cuts material at a uniform and preselected angle, (e) wherein the at least one guide cheek comprises at least two guide cheeks defining a planar surface each disposed at an angle theta relative to said knife blade such that said guide cheeks are adapted to slidably engage and move parallel along adjacent planar surfaces, thereby ensuring that the blade cuts material at a uniform and preselected angle, (f) wherein the at least two guide cheeks comprise a corner guide including first and second guide cheeks each defining a planar surface and disposed at an angle theta relative to said knife blade such that said first guide cheek is adapted to slidably engage and move parallel along a first planar surface and said second guide cheek is adapted to slidably engage and move parallel along a second planar surface thereby ensuring that the blade cuts material at a uniform and preselected angle, and (g) wherein the knife body comprises a utility end and said guide end, said the utility end including a second knife blade, such that the at least one knife blade mounted proximate the guide end is used for cutting and trimming in corners and the second knife blade mounted in said utility end is used for conventional utility knife cutting and trimming operations.

2. The utility knife claimed in claim 1 wherein the first guide cheek disposed at an angle theta one relative said knife blade and the second guide cheek disposed at an angle theta two relative to said knife blade, and said angle theta one plus theta two equals angle alpha the angle between the first guide cheek and the second guide cheek.

3. The utility knife claimed in claim 2 wherein the angle alpha is approximately 90 degrees and angles theta one and theta two are each 45 degrees, which are the preferred angles for trimming of material in corners having two planar surfaces oriented substantially 90 degrees relative each other.

4. The utility knife claimed in claim 1 wherein the utility end including a chisel end, such that the at least one knife blade mounted proximate the guide end is used for cutting and trimming in corners and the chisel end is used for creasing, smoothing when installing thin planar materials.

5. The utility knife claimed in claim 1 wherein the knife body comprises a chisel end proximate said guide end, such that the at least one knife blade mounted proximate the guide end is used for cutting and trimming in corners and the chisel end is used for creasing, smoothing when installing thin planar materials, and said second knife blade mounted in said utility end is used for conventional utility knife cutting and trimming.

6. A utility knife attachment for use with hand held utility knives, the utility knife attachment comprises:

a) a knife attachment body including a guide end;

b) a means for releasably connecting said knife attachment to utility knives;

c) at least one knife blade at said guide end mounted in said knife attachment body and having a cutting direction axis;

d) said guide end including a guide means for guiding said knife in a uniform angular relationship relative to a planar surface such that the guide means minimizes rotation of the knife attachment body about said cutting direction axis.

7. The utility knife attachment claimed in claim 6 wherein the guide means comprises at least one guide cheek defining a planar surface disposed at an angle theta relative to said knife blade such that said guide cheek is adapted to slidably engage and move parallel along an adjacent planar surface thereby ensuring that the blade cuts material at a uniform and preselected angle.

8. The utility knife attachment claimed in claim 7 wherein the at least one guide cheek comprises at least two guide cheeks defining a planar surfaces disposed at angles theta relative to said knife blade such that said guide cheeks are adapted to slidably engage and move parallel along adjacent planar surfaces thereby ensuring that the blade cuts material at a uniform and preselected angle.

9. The utility knife attachment claimed in claim 8 wherein the at least two guide cheeks comprise a corner guide including first and second guide cheeks each defining a planar surface and disposed at an angle relative to said knife blade such that said first guide cheek is adapted to slidably engage and move parallel along a first planar surface and said second guide cheek is adapted to slidably engage and move parallel along a second planar surface thereby ensuring that the blade cuts material at a uniform and preselected angle.

10. The utility knife attachment claimed in claim 9 wherein the first guide cheek being disposed at an angle theta one relative said knife blade and the second guide cheek disposed at an angle theta two relative to said knife blade, and said angle theta one plus theta two equals angle alpha the angle between the first guide cheek and the second guide cheek.

11. The utility knife attachment claimed in claim 10 wherein the angle alpha is approximately 90 degrees and angles theta one and theta two are each 45 degrees, which are the preferred angles for trimming of material in corners having two planar surfaces oriented 90 degrees relative each other.

12. The utility knife attachment claimed in claim 9 wherein the knife attachment body comprises a chisel end proximate said guide end, such that the at least one knife blade mounted proximate the guide end is used for cutting and trimming in corners and the chisel end is used for creasing, smoothing when installing thin planar materials.

13. In combination a knife attachment as claimed in claim 9, and a hand held utility knife, comprising:

a) said knife attachment releasably attached and mated to said hand held knife with said connecting means;

b) wherein said connecting means includes a boot connector for snugly receiving a cutting end of said utility knife; and c) said connecting means further comprising a locking screw for releasably clamping said knife attachment to said cutting end of said utility knife such that the knife attachment mated together with said utility knife is adapted for cutting and trimming in corners where two planar surfaces meet.

14. In combination a knife attachment as claimed in claim 6, and a hand held utility knife, comprising said knife attachment releasably attached and mated to said hand held knife with said connecting means such that the knife attachment mated together with said utility knife is adapted for cutting and trimming in corners where two planar surfaces meet.

15. In combination a knife attachment as claimed in claim 6, and a hand held utility knife, comprising:

a) said knife attachment releasably attached and mated to said hand held knife with said connecting means;

b) wherein said connecting means includes a boot connector for snugly receiving a cutting end of said utility knife; and c) said connecting means further comprising a locking screw for releasably clamping said knife attachment to said cutting end of said utility knife such that the knife attachment mated together with said utility knife is adapted for cutting and trimming in corners where two planar surfaces meet.

* * * * *